US007712479B2

(12) United States Patent
Sundarrao

(10) Patent No.: US 7,712,479 B2
(45) Date of Patent: May 11, 2010

(54) FOLDING CRUTCH

(75) Inventor: Stephen Sundarrao, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 11/872,076

(22) Filed: Oct. 15, 2007

(65) Prior Publication Data

US 2008/0087312 A1 Apr. 17, 2008

Related U.S. Application Data

(60) Provisional application No. 60/829,365, filed on Oct. 13, 2006.

(51) Int. Cl.
*A61H 3/02* (2006.01)
*A45B 9/02* (2006.01)

(52) U.S. Cl. ..... 135/74

(58) Field of Classification Search ..... 135/65, 135/68, 69, 71, 72, 73, 74, 66; 403/92, 93, 403/95, 96

See application file for complete search history.

(56) References Cited

U.S. PATENT DOCUMENTS

| | | | | | |
|---|---|---|---|---|---|
| 2,575,681 | A | * | 11/1951 | Peters | 135/68 |
| 2,711,183 | A | * | 6/1955 | Lofstrand, Jr. | 135/69 |
| 2,788,793 | A | * | 4/1957 | Abbott | 135/68 |
| 3,757,807 | A | * | 9/1973 | Manzo | 135/71 |
| 4,184,503 | A | | 1/1980 | Nakajima | |
| 4,253,478 | A | | 3/1981 | Husa | |
| 4,747,423 | A | | 5/1988 | Hansen et al. | |
| 4,869,280 | A | | 9/1989 | Ewing | |
| 5,038,811 | A | | 8/1991 | Gilmore | |
| 5,287,870 | A | * | 2/1994 | Rhodes | 135/72 |
| 5,325,879 | A | | 7/1994 | Burns | |
| 5,329,954 | A | * | 7/1994 | Miyoshi | 135/71 |
| 5,402,811 | A | | 4/1995 | Weng | |
| 5,564,451 | A | | 10/1996 | Hagberg | |
| 5,624,199 | A | * | 4/1997 | Cheng | 403/100 |
| 5,671,765 | A | | 9/1997 | Hagberg | |
| 5,771,910 | A | | 6/1998 | Kluttz | |
| 6,169,568 | B1 | * | 1/2001 | Shigetomi | 725/76 |
| 6,732,390 | B2 | | 5/2004 | Krywiczanin | |

(Continued)

FOREIGN PATENT DOCUMENTS

DE 10015589 A1 * 11/2000

(Continued)

OTHER PUBLICATIONS http://www.fetterman-crutches.com/index.html.

(Continued)

*Primary Examiner*—David Dunn
*Assistant Examiner*—Danielle Jackson
(74) *Attorney, Agent, or Firm*—Robert Varkonyi; Smith & Hopen, P.A.

(57) ABSTRACT

A crutch enabled to fold on itself so the crutch can be stored in small places or confined areas. The crutch attaches to the forearm of a user with a flexible cuff during use. After use, an upper section and lower section of the crutch rotate toward one another using a pivoting joint. Further, the lower section of the crutch has telescoping sections, allowing the crutch to use substantially less space during storage.

6 Claims, 6 Drawing Sheets

U.S. PATENT DOCUMENTS

| | | | | |
|---|---|---|---|---|
| 6,789,848 | B2 * | 9/2004 | Rauschenberger et al. | .. 297/369 |
| H2138 | H | 1/2006 | Pullman et al. | |
| 7,104,271 | B2 | 9/2006 | Larson et al. | |
| 2004/0139995 | A1 | 7/2004 | Hsieh | |

FOREIGN PATENT DOCUMENTS

| | | | |
|---|---|---|---|
| EP | 149576 | A2 * | 7/1985 |

OTHER PUBLICATIONS http://www.awardprosthetics.com.

Shortell et al., The Design of a Compliant Composition Crutch, Journal of Rehabilitation Research and Development, vol. 38, No. 1, Jan./Feb. 2001, p. 23-32.

* cited by examiner

Results for armpiece analysis:

| Name | Value | Convergence |
|---|---|---|
| max_beam_bending: | 0.000000e+00 | 0.0% |
| max_beam_tensile: | 0.000000e+00 | 0.0% |
| max_beam_torsion: | 0.000000e+00 | 0.0% |
| max_beam_total: | 0.000000e+00 | 0.0% |
| max_disp_mag: | 1.879996e-03 | 0.7% |
| max_disp_x: | 1.103610e-05 | 1.1% |
| max_disp_y: | 3.690852e-04 | 0.7% |
| max_disp_z: | -1.873100e-03 | 0.7% |
| max_prin_mag: | -2.770727e+05 | 19.8% |
| max_rot_mag: | 0.000000e+00 | 0.0% |
| max_rot_x: | 0.000000e+00 | 0.0% |
| max_rot_y: | 0.000000e+00 | 0.0% |
| max_rot_z: | 0.000000e+00 | 0.0% |
| max_stress_prin: | 1.421634e+05 | 13.2% |
| max_stress_vm: | 2.097247e+05 | 20.6% |
| max_stress_xx: | -1.301345e+05 | 12.8% |
| max_stress_xy: | 7.601612e+04 | 14.6% |
| max_stress_xz: | 6.533867e+04 | 24.1% |
| max_stress_yy: | -1.447267e+05 | 12.0% |
| max_stress_yz: | -6.677729e+04 | 18.9% |
| max_stress_zz: | -1.678903e+05 | 21.4% |
| min_stress_prin: | -2.770727e+05 | 19.8% |
| strain_energy: | 1.857955e-01 | 0.7% |

Figure 4. A graph of the stress levels on the second support. The support was drawn using ProEngineer software and imported into ProMechanica software to perform stress analyses. The result and VonMises stresses were calculated individually using an aluminum 6160T6 density of 2.7 g/cc, and the maximum yield stress was found to be 40 ksi.

Results of handle analysis:

| Name | Value | Convergence |
|---|---|---|
| max_beam_bending: | 0.000000e+00 | 0.0% |
| max_beam_tensile: | 0.000000e+00 | 0.0% |
| max_beam_torsion: | 0.000000e+00 | 0.0% |
| max_beam_total: | 0.000000e+00 | 0.0% |
| max_disp_mag: | 1.332551e-04 | 0.6% |
| max_disp_x: | -1.928057e-06 | 0.3% |
| max_disp_y: | -1.328433e-04 | 0.6% |
| max_disp_z: | -1.535939e-05 | 0.1% |
| max_prin_mag: | 2.953362e+05 | 6.7% |
| max_rot_mag: | 0.000000e+00 | 0.0% |
| max_rot_x: | 0.000000e+00 | 0.0% |
| max_rot_y: | 0.000000e+00 | 0.0% |
| max_rot_z: | 0.000000e+00 | 0.0% |
| max_stress_prin: | 2.953362e+05 | 6.7% |
| max_stress_vm: | 2.585445e+05 | 1.7% |
| max_stress_xx: | 9.284964e+04 | 23.6% |
| max_stress_xy: | -3.949225e+04 | 11.5% |
| max_stress_xz: | 7.474907e+04 | 21.4% |
| max_stress_yy: | 1.358380e+05 | 21.9% |
| max_stress_yz: | -1.251760e+05 | 1.1% |
| max_stress_zz: | 1.763654e+05 | 9.5% |
| min_stress_prin: | -4.873200e+04 | 57.1% |
| strain_energy: | 1.315293e-02 | 0.5% |

Figure 5. A graph of the handle stress levels. The handle grip was drawn using ProEngineer software and imported into ProMechanica software to perform stress analyses. The result and VonMises stresses were calculated individually using an aluminum 6160T6 density of 2.7 g/cc, and the maximum yield stress was found to be 40 ksi.

Results of middle tube analysis:

| Name | Value | Convergence |
|---|---|---|
| max_beam_bending: | 0.000000e+00 | 0.0% |
| max_beam_tensile: | 0.000000e+00 | 0.0% |
| max_beam_torsion: | 0.000000e+00 | 0.0% |
| max_beam_total: | 0.000000e+00 | 0.0% |
| max_disp_mag: | 4.711125e-06 | 0.1% |
| max_disp_x: | 6.846034e-07 | 1.6% |
| max_disp_y: | -4.710814e-06 | 0.1% |
| max_disp_z: | 6.746248e-07 | 0.1% |
| max_prin_mag: | -5.654293e+03 | 4.6% |
| max_rot_mag: | 0.000000e+00 | 0.0% |
| max_rot_x: | 0.000000e+00 | 0.0% |
| max_rot_y: | 0.000000e+00 | 0.0% |
| max_rot_z: | 0.000000e+00 | 0.0% |
| max_stress_prin: | 4.349300e+03 | 6.8% |
| max_stress_vm: | 7.646447e+03 | 8.8% |
| max_stress_xx: | -2.182388e+03 | 7.9% |
| max_stress_xy: | 1.332283e+03 | 17.6% |
| max_stress_xz: | -8.347051e+02 | 7.3% |
| max_stress_yy: | -5.223190e+03 | 0.1% |
| max_stress_yz: | -4.110978e+03 | 8.9% |
| max_stress_zz: | 3.823267e+03 | 5.6% |
| min_stress_prin: | -5.654293e+03 | 4.6% |
| strain_energy: | 4.569736e-04 | 0.1% |

Figure 6. A graph of the stress levels of the first support. The support was drawn using ProEngineer software and imported into ProMechanica software to perform stress analyses. The result and VonMises stresses were calculated individually using an aluminum 6160T6 density of 2.7 g/cc, and the maximum yield stress was found to be 40 ksi.

FOLDING CRUTCH

CROSS REFERENCE TO RELATED APPLICATION

This application claims priority to currently pending U.S. Provisional Patent Application No. 60/829,365, entitled "Folding Crutch", filed on Oct. 13, 2006, the contents of which are herein incorporated by reference.

FIELD OF INVENTION

This invention relates to walking aids and crutches.

BACKGROUND OF THE INVENTION

Walking sticks have aided man since the beginning of time. A major design change from the T shaped crutch was replaced by the "bow" underarm crutch. These basic crutches were called "Splits", because a piece of wood was cut vertically then spread apart in a "V" shape and affixing a wooden cradle shaped underarm piece to the top and a handle lower down. The early models did not have tips or padding. A deluxe and more expensive crutch was later designed. The unforgiving wooden underarm was replaced with a firm leather wrapped hammock-like pouch stuffed with the long hairs of a horse's tail for strength. The tips of these early manufactured crutches and canes were non-existent or made of metal because the terrain at the time was mostly soft and rugged. It wasn't until the 19th century when hard, smooth manmade surfaces became dominant that rubber tips became common.

World War I provided more advances in crutch tip technology. In 1919, George Hippwood patented a crutch tip with an air bladder inside. His patent included one of the first height adjustable underarm supports.

The Polio epidemics effected people with both affected legs and weakened arms it was necessary to support the biceps and the triceps. With Theodore Roosevelt's help, the Warm Springs Crutch was designed with a metal cuff above and below the elbow for the extra needed support. Others who had paralyzed legs but unaffected arm strength were issued the Kenny "arm-band" crutch. The Kenny crutch is a wooden bow crutch similar to the sling top wooden bow crutch but instead of the sling top there is a wide circular leather band attached to the top of the crutch. This fits loosely around the forearm.

World War II and the Korean War along with another polio epidemic provided the handicapped for the next major change in crutch design. The forearm style crutch often referred to as the Loftstrand crutch, the brand name of one of the early manufactures. The forearm style crutch now dominates the world's long-term crutch user market. In fact in Europe the forearm crutch is the style of choice for the short-term user market as well.

The forearm crutch does not put constant pressure on the underarm that can cause nerve damage, resulting in a serious medical condition, like traditional crutches, and therefore are more appropriate for people with long-term needs. However, the crutches must be carried by the disabled individual at all times, which can be inconvenient. Traveling can be especially troublesome, as crutches cannot be held on the disable individual's lap on airplanes since the crutches pose a danger in the event of an emergency on take-off or landing. Further, long periods of time spent in close quarters make the bulk of crutches troublesome.

SUMMARY OF INVENTION

Current walking aid technology fails to account for the active lifestyle of many disabled individuals. The invention uses aluminum materials in constructing an ultra-light, highly portable forearm crutch. The crutch folds into a series of pieces, and can be collapsed.

The crutch features a flexible cuff that surrounds the forearm just below the elbow, reducing arm strain. The design adds the convenience of full adjustability for multiple positioning, benefiting the special needs of the handicapped. Further, the crutch is foldable, and may be stored in small spaces, allowing the handicapped more freedom to travel or be in close confined spaces. A stress analysis was performed on various parts to ensure stability and proper support, while minimizing the costs to manufacture.

BRIEF DESCRIPTION OF THE DRAWINGS

For a fuller understanding of the invention, reference should be made to the following detailed description, taken in connection with the accompanying drawings, in which:

FIG. 4 is a graph of the forearm support member stress analysis.

FIG. 5 is a graph of the handle grip stress analysis.

FIG. 6 is a graph of the vertical support member stress analysis.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
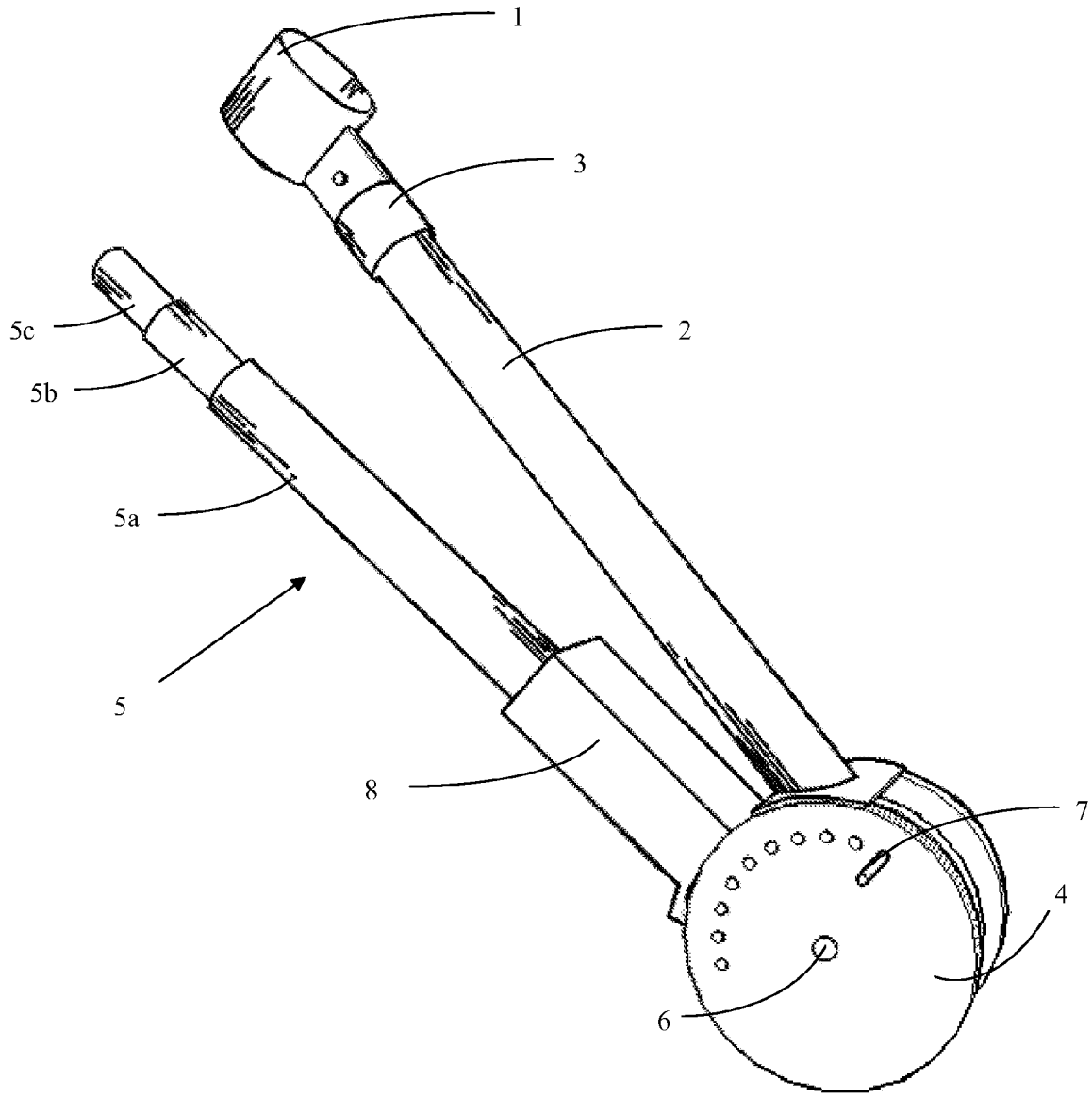
FIG. 1 is a side perspective view of the crutch in its compacted, stored position.

The present invention includes a device for aiding disabled individuals with walking, as shown in FIG. 1. Forearm support cuff 1, preferably a flexible armband cuff, mounts to an adapter ring 3, which attaches to the end of second support 2. Forearm support cuff 1 is attached to adapter ring 3 using a pin, such that the forearm support may rotate longitudinally in relation to second support 2. The end opposite the forearm adapter on second support 2, the forearm support member has a circular disk, which comprises an inner ring of circular indexing joint 4. The center of indexing joint 4 has a pivot pin 6, allowing the joint to rotate. A plurality of holes run along the face of the indexing joint, such that locking pin 7 can be inserted into the holes locking indexing joint 4 into a set position. Handle grip 8 attaches at one end to indexing joint 4, and rotates around the indexing joint in longitudinal relation to second support 2. First support 5 attaches to indexing joint 4 on one end, such that first support 5 and second support 2 rotate in a longitudinal manner to one another from indexing joint 4. First support 5 has telescoping members 5*a*, 5*b*, and 5*c*, such that the members slide upon one another from a locked stored position to a locked usable position. Preferably, Aluminum 6160T6 tubing is used in constructing first support 5, second support 2, adapter ring 3, and indexing joint 4.

The crutch may be folded and stored in a compact position. In this position, handle grip 8 slides over First support 5. Second support 2 and First support 5 rotate such that the members are in close proximity to one another, shown in FIG. 1. The telescoping members, 5*a* through 5*c*, of First support 5, slide together such that the telescoping members overlap one another, as known in the art.

Figure 2:
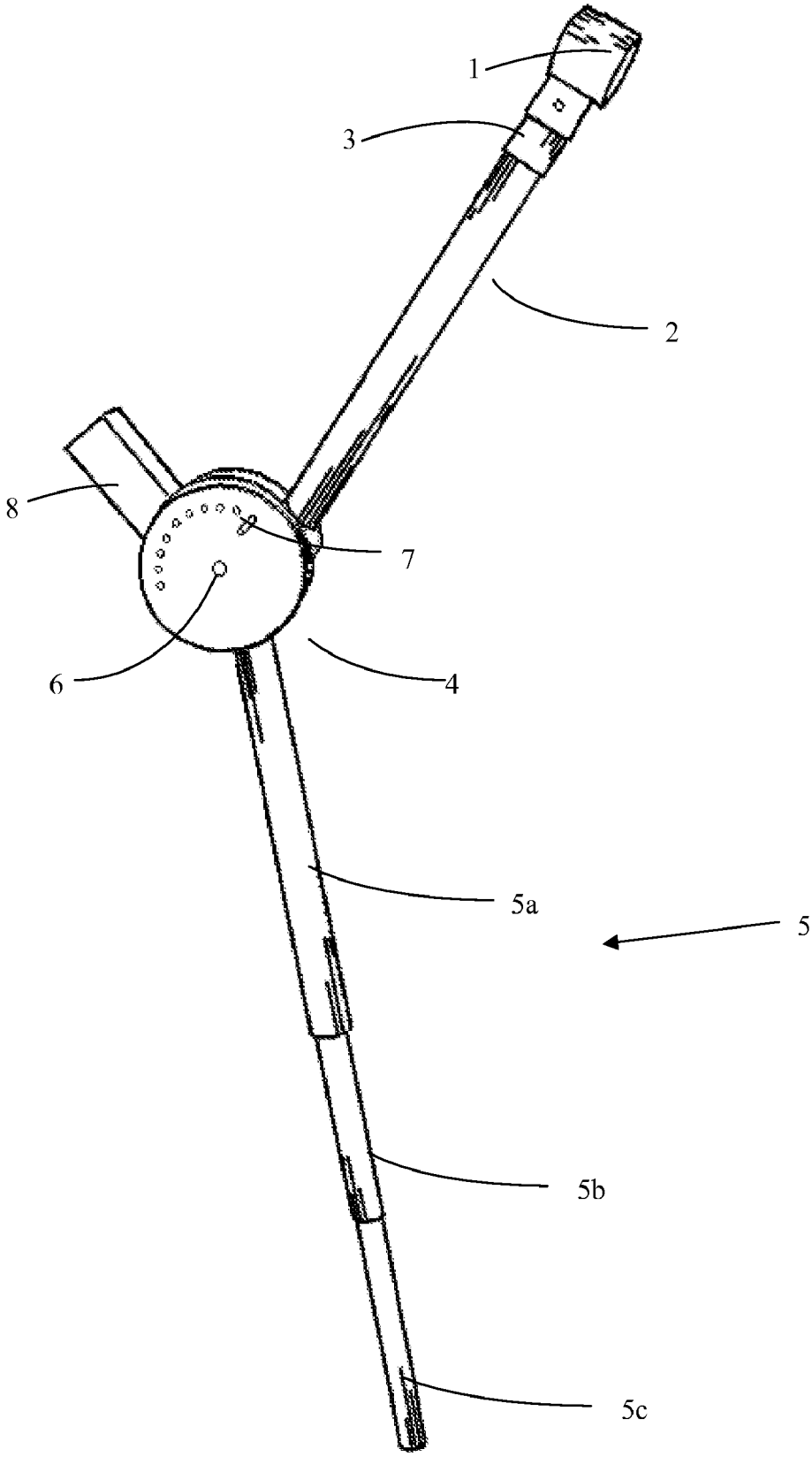
FIG. 2 shows a side perspective view of the crutch during transition from the stored position to the extended, usable position. The support members have separated to the usable position.
Figure 3:
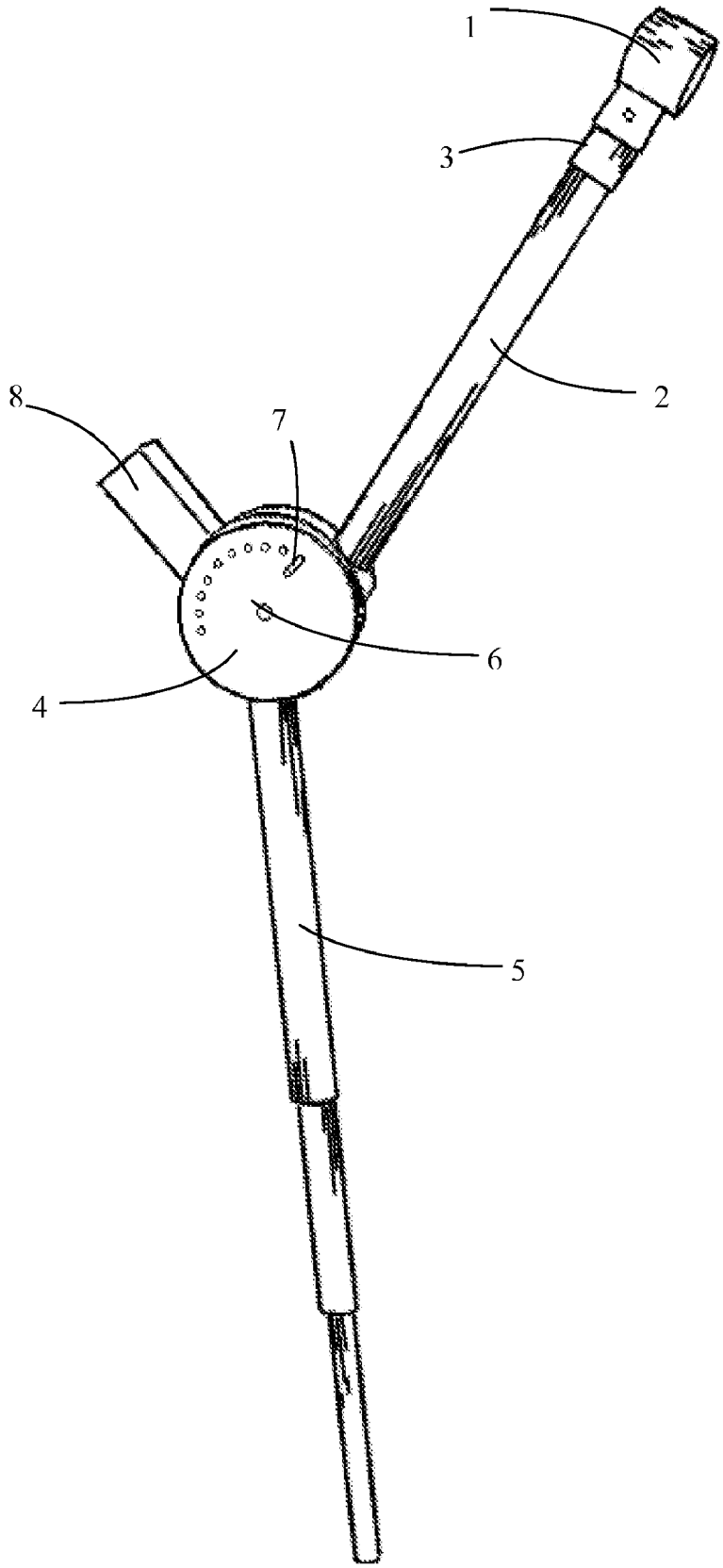
FIG. 3 is a side perspective view of the crutch during transition from the stored position to the extended, usable position.

Prior to use, the crutch must be transferred from its stored position to a usable position. Locking pin 7 is removed from indexing joint 4. Handle grip 8 rotates about indexing joint 4. First support member 5 then rotates about indexing joint 4 to a position from 10 to 93 degrees relative to second support 2, seen in FIG. 2. Once the user selects a comfortable angle, locking pin 7 is returned into the holes in indexing joint 4, fixing the position of the second support member and first support member and handle grip, seen in FIG. 3. The lower telescoping members of first support 5 are slid to an extended position, such that the members are exposed and no longer substantially overlapping one another. The user may than place his or her arm into forearm support cuff 1. Forearm support cuff 1 then rotates longitudinally in relation to second support 2 such that forearm support cuff 1 and second support 2 are substantially aligned with the arm of the user.

Stress analyses were performed on the crutch assembly. The sub-assemblies were drawn with a ProEngineer software package and imported into ProMechanica software to perform analyses. The result and VonMises stresses were calculated individually for the middle tube in the shaft, the handle/bracket assembly, and the forearm support/bracket. For Aluminum 6160T6 the density was found in Matweb to be 2.7 g/cc. and the maximum yield stress was found to be 40 ksi, based on Mechanics of Materials (Gere, $5^{th}$ ed., 2000).

The force loads on the arm piece were placed perpendicular to the end of the tube, on the arm rests of the cuff. They were also placed inside the center hole for the pivot point of the bracket. The handle/bracket assembly was loaded at various points along the handle, in the center pivot point and the variable position hole. Loading was placed and the top and bottom positions of the middle tube of the shaft. The maximum stresses, rotation, and displacement were calculated for all assemblies and the middle tube, as shown in FIGS. 4 though 6. At no time did the maximum stresses exceed the yield stress for Aluminum 6160T6.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A collapsible crutch utilizable in an under-arm or forearm application, comprising:

a first support, having an upper end and a lower end;

an indexing joint connected to the first support at its upper end comprising at least three locking positions, and further comprising:

a circular housing disposed on the upper end of the first support and comprising a pivoting ring disposed within the housing and in communication with the second support;

a first position on the indexing joint such that the first support and a second support are disposed substantially parallel;

a second position on the indexing joint such that the first support and the second support are disposed at between 10 and 93 degrees;

a third position on the indexing joint disposed between the first position on the indexing joint and the second position on the indexing joint;

a hand grip directly pivotally connected to the indexing joint and adapted to independently articulate;

the second support having an upper end and a lower end, connected to the indexing joint at its lower end; and a forearm support cuff disposed perpendicular to the longitudinal axis of the second support, such that the forearm support cuff rotates about an axis perpendicular to the longitudinal axis of the second support.

2. The crutch of claim 1 wherein the bottom of the first support is adapted to contact a walking surface.

3. The crutch of claim 1 wherein the indexing joint has holes disposed along the face to lock the joint and prevent rotation.

4. The crutch of claim 3 wherein a locking pin is inserted into the index joint holes.

5. The crutch of claim 1 wherein the first support telescopes.

6. The crutch of claim 1 wherein the indexing joint is hand tightened and loosened.

* * * * *